US010601178B2

(12) United States Patent
Spilker

(10) Patent No.: US 10,601,178 B2
(45) Date of Patent: Mar. 24, 2020

(54) LOCKING CLIP FOR A PLUG CONNECTOR HOUSING

(71) Applicant: HARTING Electric GmbH & Co. KG, Espelkamp (DE)

(72) Inventor: Nicole Spilker, Lübbecke (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 16/325,220

(22) PCT Filed: Oct. 16, 2017

(86) PCT No.: PCT/DE2017/100880
§ 371 (c)(1),
(2) Date: Feb. 13, 2019

(87) PCT Pub. No.: WO2018/082735
PCT Pub. Date: May 11, 2018

(65) Prior Publication Data

US 2019/0207345 A1 Jul. 4, 2019

(30) Foreign Application Priority Data

Nov. 3, 2016 (DE) ..... 10 2016 120 929

(51) Int. Cl.
*H01R 13/629* (2006.01)
*H01R 43/26* (2006.01)

(52) U.S. Cl.
CPC . *H01R 13/62966* (2013.01); *H01R 13/62955* (2013.01); *H01R 43/26* (2013.01)

(58) Field of Classification Search
CPC ..... H01R 43/26
See application file for complete search history.

(56) References Cited

U.S. PATENT DOCUMENTS 4,241,966 A * 12/1980 Gomez ..... H01R 12/7005 439/157
5,022,866 A * 6/1991 Harting ..... H01R 13/629 439/370

(Continued)

FOREIGN PATENT DOCUMENTS

DE 1151580 B 7/1963
DE 2915574 C2 5/1988

(Continued)

*Primary Examiner* — Edwin A. Leon
*Assistant Examiner* — Milagros Jeancharles
(74) *Attorney, Agent, or Firm* — Smartpat PLC

(57) ABSTRACT

The invention relates to a locking device for plug connector housings, wherein the locking device (1) can be mounted pivotably on a first plug connector housing (12), wherein the locking device (1) can be locked on a second plug connector housing (14), as a result of which the first and the second plug connector housings (12, 14) can be pressed resiliently against each other. The locking device has means which prevent inadvertent opening of a closed plug connection. This makes it possible to avoid machine failures and accidents. The invention also relates to a method for releasing a first plug connector housing (12) from a second plug connector housing (14) with a locking device (1) which is mounted pivotably on the first plug connector housing (12) and can be locked on the second plug connector housing (14), wherein a force required for a pivoting-open movement increases abruptly during the pivoting-open movement.

10 Claims, 5 Drawing Sheets

(56) References Cited

U.S. PATENT DOCUMENTS 5,385,870 A 1/1995 Maue et al.
5,401,179 A * 3/1995 Shinchi ..... H01R 13/62933 439/157
5,873,745 A * 2/1999 Duclos ..... H01R 13/62944 439/157
6,036,510 A * 3/2000 Ono ..... H01R 13/62922 439/152
6,558,176 B1 * 5/2003 Martin ..... H01R 13/62944 439/157
7,717,723 B2 * 5/2010 Nehm ..... H01R 13/62966 439/157
7,785,131 B2 * 8/2010 Ferderer ..... H01R 13/62933 439/157
8,376,772 B2 * 2/2013 Lizanets ..... H01R 13/5202 439/372
8,979,568 B2 * 3/2015 Herbrechtsmeier ..... H01R 13/62966 439/346
9,197,017 B2 * 11/2015 Wu ..... H01R 13/62966
9,564,710 B2 * 2/2017 Ebihara ..... H01R 13/62938
9,583,877 B1 * 2/2017 Angelucci ..... G06K 7/00
10,305,218 B2 * 5/2019 Griepenstroh ..... H01R 13/5213
10,320,110 B2 * 6/2019 Loetkemann ..... H01R 13/42
10,439,325 B2 * 10/2019 Kritter ..... H01R 13/62966
2006/0270257 A1 * 11/2006 Duval ..... H01R 13/62938 439/157
2009/0258530 A1 * 10/2009 Nehm ..... H01R 13/62955 439/372
2010/0248513 A1 * 9/2010 Ferderer ..... H01R 13/62955 439/157
2011/0053405 A1 * 3/2011 Kobayashi ..... H01R 13/62955 439/345
2011/0271507 A1 * 11/2011 Takatsu ..... H01R 13/62938 29/428
2012/0115346 A1 * 5/2012 Zwanger ..... H01R 13/62955 439/310

FOREIGN PATENT DOCUMENTS

DE 4129236 A1 3/1993
DE 19828414 A1 12/1999
DE 202005005241 U1 12/2005
DE 102004061046 2/2007
DE 102007023019 2/2010
DE 102008019009 1/2011
EP 1253676 A3 1/2004

* cited by examiner

LOCKING CLIP FOR A PLUG CONNECTOR HOUSING

TECHNICAL FIELD

The invention relates to a locking clip for plug connector housings and to a method for unlocking two plug connector housings.

BACKGROUND

Locking clips are used to lock in a reversible manner two plug connector housings that are plugged together.

DE 29 15 574 A1 illustrates a locking clip for locking a first plug connector housing to a second plug connector housing in a reversible manner. The locking clip is manufactured from a resilient wire.

DE 10 2004 061 046 B4 illustrates a locking clip that is stamped out of a sheet metal piece and produces a resilient locking arrangement between two plug connector housings.

Since the plug connector housings are protected on the plugging side by means of a rubber seal to prevent media from penetrating, it is not possible to dimension the resilient force of the locking clip to be too high since the seal could otherwise become damaged and lose its sealing effect. If the cables that are connected to the plug connecter are unintentionally subjected to a pulling load, the above described locking clip may fail and the plug connection may be inadvertently unlocked. This may lead by way of example to machines undesirably coming to a standstill.

The object of the invention is to propose a reliable and reversible locking clip for plug connectors.

SUMMARY

A locking clip in accordance with the invention is used to lock together in a reversible manner a first and a second plug connector housing in the plugged-in state. The plug connector housings may comprise electrical, pneumatic and/or FOC-contact elements. It should not be possible to inadvertently release the contacting arrangement of the plug connector housings in the plugged-in state.

The locking clip may be mounted in such a manner as to be able to pivot on a first plug connector housing. The locking clip may comprise for this purpose two pivot holes that are arranged at the end and which may engage with pivot pins that are integrally formed on the first plug connector housing.

The locking clip may be locked to a second plug connector housing. The locking clip may comprise for this purpose receiving slots that may engage locking pins that are integrally formed on the second plug connector housing.

The first and the second plug connector housing are pressed together in a resilient manner by the locking clip.

The two plug connector housings are locked together via a pivot movement of the locking clip in the direction of the second plug connector housing. A pivot movement of the locking clip away from the second plug connector housing unlocks the connection.

The locking clip comprises means that prevent a plug connection between two plug connector housings from being unintentionally or inadvertently opened. It is thereby possible to prevent that two plug connectors that are plugged together are pulled apart inadvertently. The means are provided by the shape and the construction of the locking clip.

The locking clip may be configured in an essentially U-shaped manner. The locking clip comprises a rear wall from which two lateral arms are bent outward at a 90° angle. The lateral arms are each divided into a lower arm and an upper arm. Accordingly, the upper and the lower arm are formed integrally on a rear wall.

The upper and the lower arm each comprise at least one lever. The upper arm lever of the upper arm and the associated lower arm lever of the lower arm overlap one another and are oriented parallel to one another. The levers are each used as a stopping point when a specific force is exerted in a pivot movement of the locking clip away from the second plug connector housing (opening pivot movement).

In an advantageous embodiment of the invention, during the unlocking procedure the locking clip is influenced by a first force over a first travel path and by a second force over a second travel path. In so doing, the first force is less than the second force. During the first travel path, the levers of the upper and lower arm are brought together. During the second travel path, the levers are in contact with one another as a result of which the required force application to produce a further pivot movement is increased.

The lower arm is advantageously provided in each case with a pivot hole that is integrally formed thereon and by which the locking clip may be pivotably mounted on two pivot pins in such a manner as to be able to rotate on the first plug connector housing, said pivot pins being oriented in a coaxial manner with respect to one another. The respective upper arm is provided in each case with a receiving slot by which the locking clip may be locked to two locking pins of the second plug connector housing, said locking pins being oriented in a coaxial manner with respect to one another.

It is preferred that the locking clip comprises an actuating grip. It is possible via the actuating grip to exert the above described force or rather the different forces for the opening pivot movement. The actuating grip is integrally formed on the rear wall.

The locking clip is preferably made from a resilient metal sheet. A locking clip of this type may be stamped out of a sheet metal piece and bent accordingly into shape. A manufacturing method of this type is very cost-effective to perform.

The locking clip comprises a rear wall and lateral arms that are bent out of said rear wall at a 90° angle. The lateral arms may each be divided into an upper arm and a lower arm. Accordingly, a locking clip that is configured in such a manner comprises two upper arms and two lower arms that each comprise a lever. The upper arm lever of the upper arm is oriented parallel to the lower arm lever of the lower arm. Moreover, the aforementioned arm levers overlap one another at least in part in the pivot direction or rather within the pivot plane.

In other words, the locking clip comprises levers that overlap on both sides, are oriented in a parallel manner, come into contact with one another during the opening pivot movement and produce a greater resistance during the opening pivot movement. It is necessary until the levers come into contact with one another during the opening pivot movement to initially use a first force that is than a second force that must be used if the arm levers are in contact with one another. A discontinuity in the graph could be established in a path-force diagram at the moment the arm levers come into contact with one another. The clip at this point is therefore only moved against an increased resistance that is clearly perceivable for the user. The above described increase in resistance during the opening pivot movement prevents the plugged-in and locked plug connector housings from being unintentionally pulled apart.

An opening pivot movement with the locking clip in accordance with the invention may be described via two or three different states:

The plug connector housings are locked together. In the first state, the above described levers are oriented parallel to one another in the pivot direction and overlap one another at least in part. The levers are spaced apart from one another, in other words the distance between the arm levers is greater than zero. The levers are located in the same plane with the result that it is possible to bring them into contact with one another. The above described pivot movement is performed along a first pivot axis that lies in the region of the rear wall or rather on the rear wall. The rear wall is bent during this pivot movement.

During the opening pivot movement of the locking clip along a first travel path, the above mentioned levers are brought into contact with one another. The distance between the levers is equal to zero in this case. The pivot movement now moves into a second state. During the further pivot movement of the locking clip, the levers continue to remain in contact with one another. The locking clip is moved in so doing about a second axis of rotation. The second axis of rotation is formed by the connecting line of the pivot pins of the first plug connector housing. The further pivot movement must be performed with a greater application of force than the first pivot movement during which the levers are not yet in contact with one another. The force that is required for the opening pivot movement increases in a step function from this moment onward. The receiving slots are pivoted outward over the locking pins of the second plug connector housing.

In the third state, the locking pins of the second plug connector housing are not gripped by the receiving slots of the locking clip.

It is possible using the illustrated locking clip with relatively low actuating forces to achieve very high retaining forces. The locking unit is overall very user friendly.

BRIEF DESCRIPTION OF THE DRAWINGS

An exemplary embodiment of the invention is illustrated in the drawings and explained in detail below.

DETAILED DESCRIPTION

Figure 1:
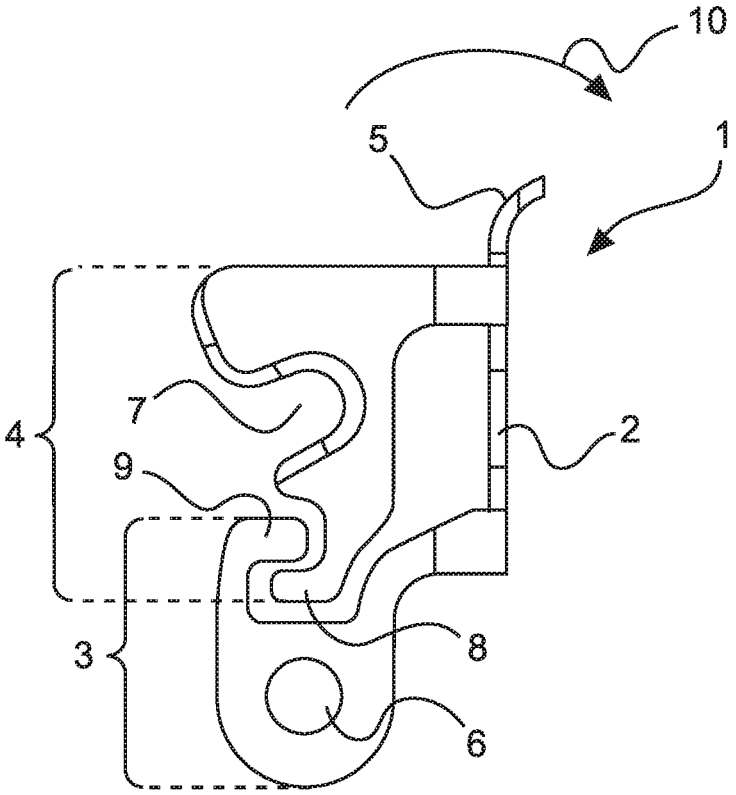
FIG. 1 illustrates a lateral view of a locking clip.

The figures illustrate in part simplified, schematic views. Identical reference numerals are sometimes used for identical but where appropriate non-identical elements. Different aspects of identical elements may be scaled differently.

Figure 2:
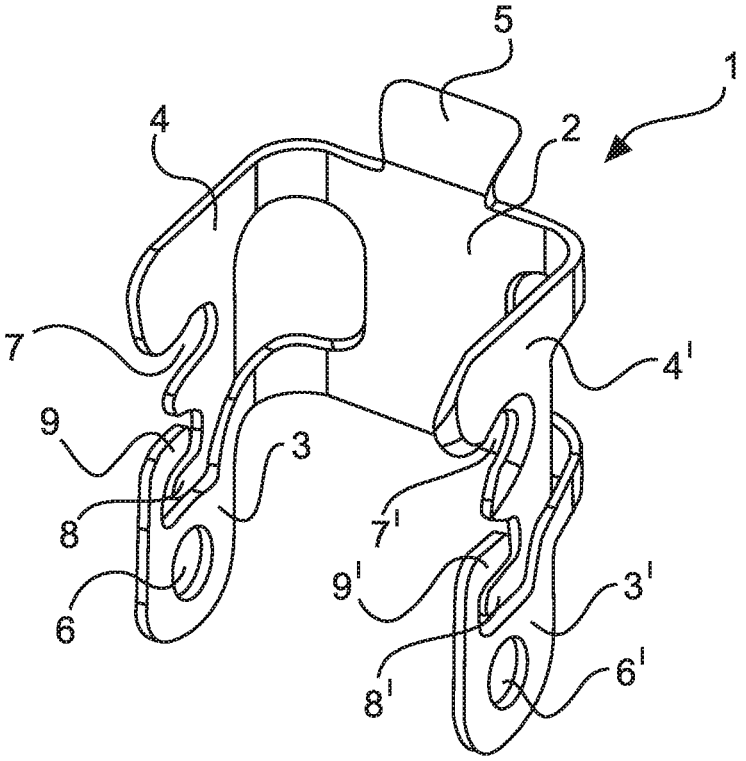
FIG. 2 illustrates a perspective view of the locking clip.
Figure 3:
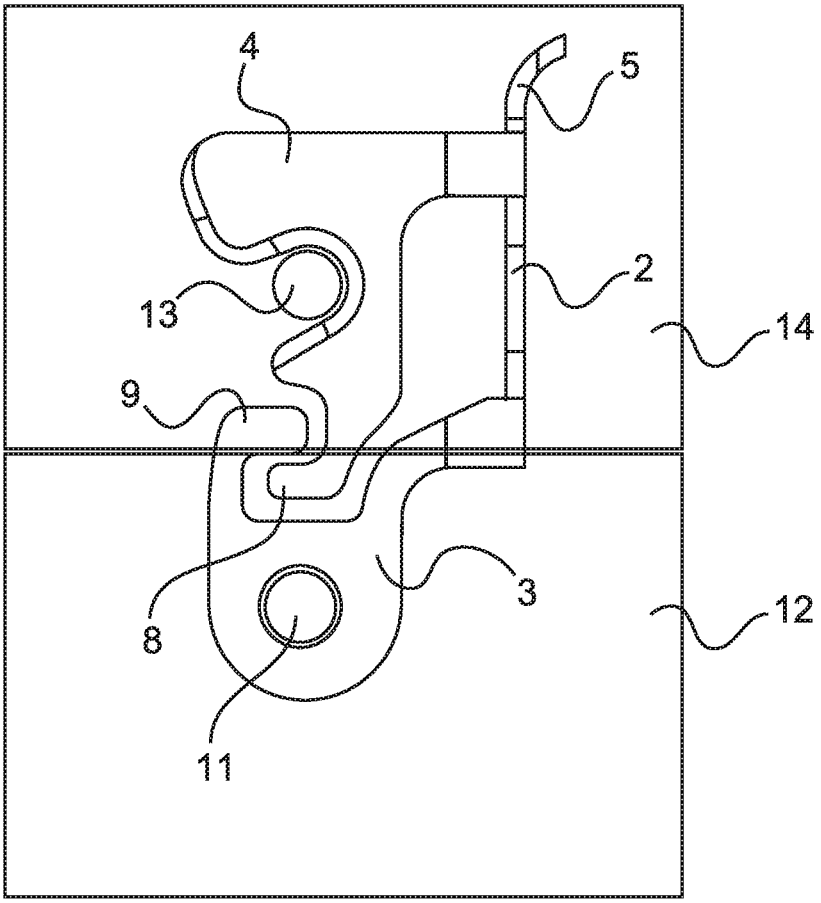
FIG. 3 illustrates a schematic sketch of two plug connector housings that are locked by the locking clip.

FIGS. 1 and 2 illustrate a locking clip 1. Such a locking clip may be manufactured by stamping out the contour from a flat sheet metal piece and subsequently performing a bending procedure.

The locking clip 1 has a U-shaped cross section and is configured essentially from a rear wall 2 from which two lateral arms are bent outward. The lateral arms comprise in each case an upper arm 4 and a lower arm 3. An actuating grip 5 is integrally formed on the rear wall 2. It is possible to operate the locking clip 1 manually using the actuating grip 5.

A pivot hole 6, 6' in the form of an opening is provided in the lower arm 3, 3'. This renders it possible to mount the locking clip 1 in a pivotable manner on two pivot pins 11 of a first plug connector housing 12. A receiving slot 7, 7' is integrally formed in the upper arm 4, 4'. The receiving slot 7, 7' may engage a locking pin 13 of a second plug connector housing 14, whereby the first plug connector housing 12 and the second plug connector housing 14 are pressed against one another in a resilient manner.

An upper arm lever 8, 8' on the upper arm 4 is oriented parallel to a lower arm lever 9, 9' of the lower arm 3. The levers are spaced apart by 0.6 mm up to 2 mm (millimeter), particularly preferred however by 1.2 mm to 1.8 mm with respect to one another. If the locking clip 1 is pivoted in the direction of the arrow 10 away from the second plug connector housing 14 in the direction of the arrow 10, the resilient rear wall 2 or rather the upper arm 4 that is connected thereto is bent by means of the prevailing first force. As a consequence, the upper arm levers 8, 8' of the upper arms 4, 4' come into contact with the lower arm levers 9, 9' of the lower arms 3, 3'. A user now notices an increased resistance in the pivot movement. The force required for the opening pivot movement increases in a step from this point onward. In order now to pivot the locking clip 1 completely away from the locking pin 13 of the second plug connector housing 14, it is necessary to apply a second force that is greater than the previous first force.

A short description is provided below of the method with which two plug connector housings that are plugged together may be unlocked.

Initially, (a) the locking clip 1 is pivoted away from the second plug connector housing 14 along a first travel path. In so doing, the upper arm lever 8 of the upper arm 4 or rather the upper arm levers 8, 8' of the upper arms 4, 4' are moved in the direction of the lower arm lever 9 of the lower arm 3 or rather of the lower arm levers 9, 9' of the lower arms 3, 3'. In so doing, the said lower arm levers of the lower arms 9, 9' are brought into contact with the upper arm levers 8, 8' of the upper arms 4.

Subsequently (b), the locking clip 1 is pivoted away from the second plug connector housing 14 along a further second travel path. In so doing, the upper arm lever 8, 8' of the upper arm 4, 4' or rather the upper arm levers 8, 8' of the upper arms 4, 4' remain in contact with the lower arm lever 9, 9' of the lower arm 3, 3' or rather with the lower arm levers 9, 9' of the lower arms 3, 3'.

Figure 4A:
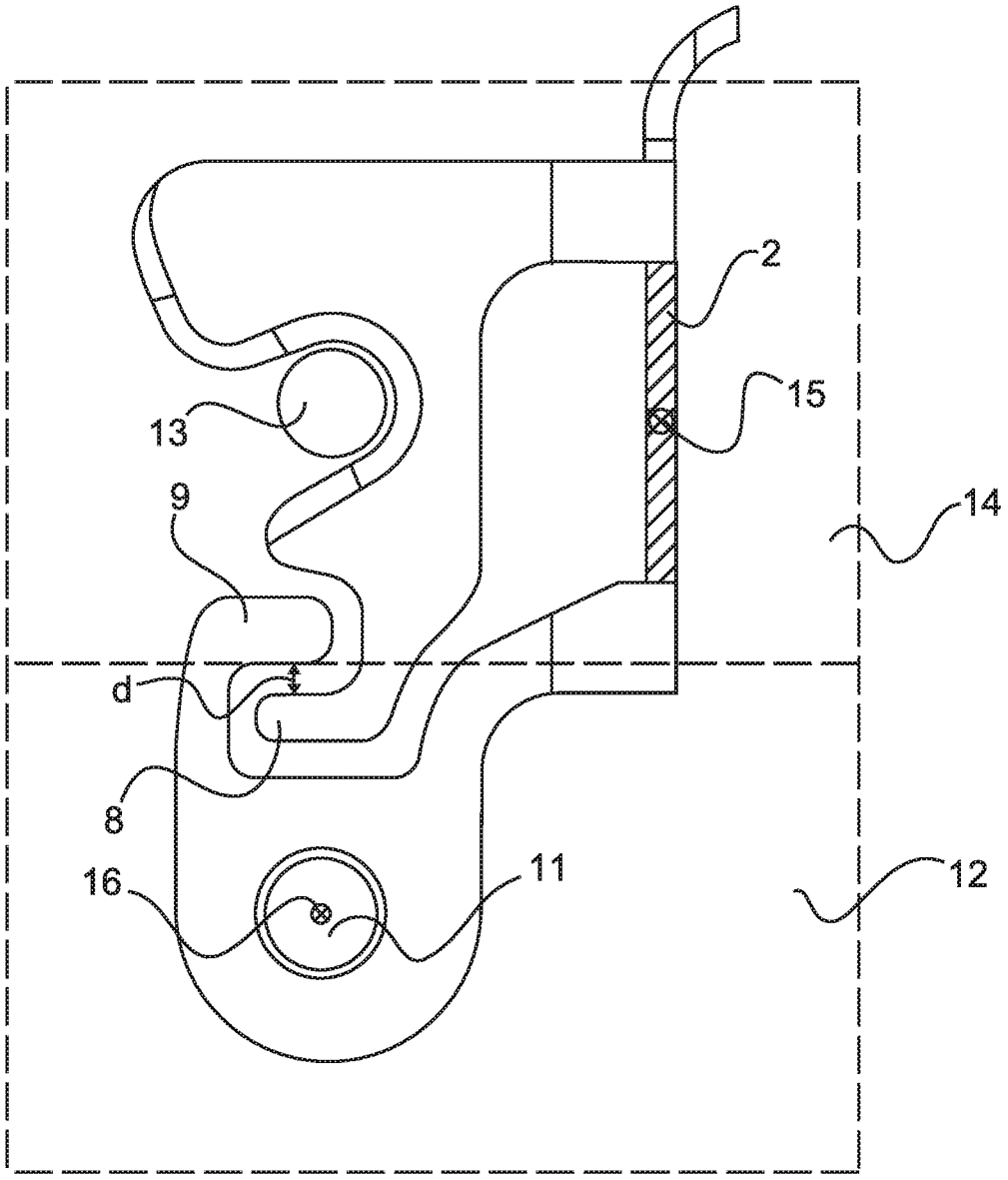
FIG. 4*a* illustrates a schematic view of an opening pivot movement of the locking clip.
Figure 4B:
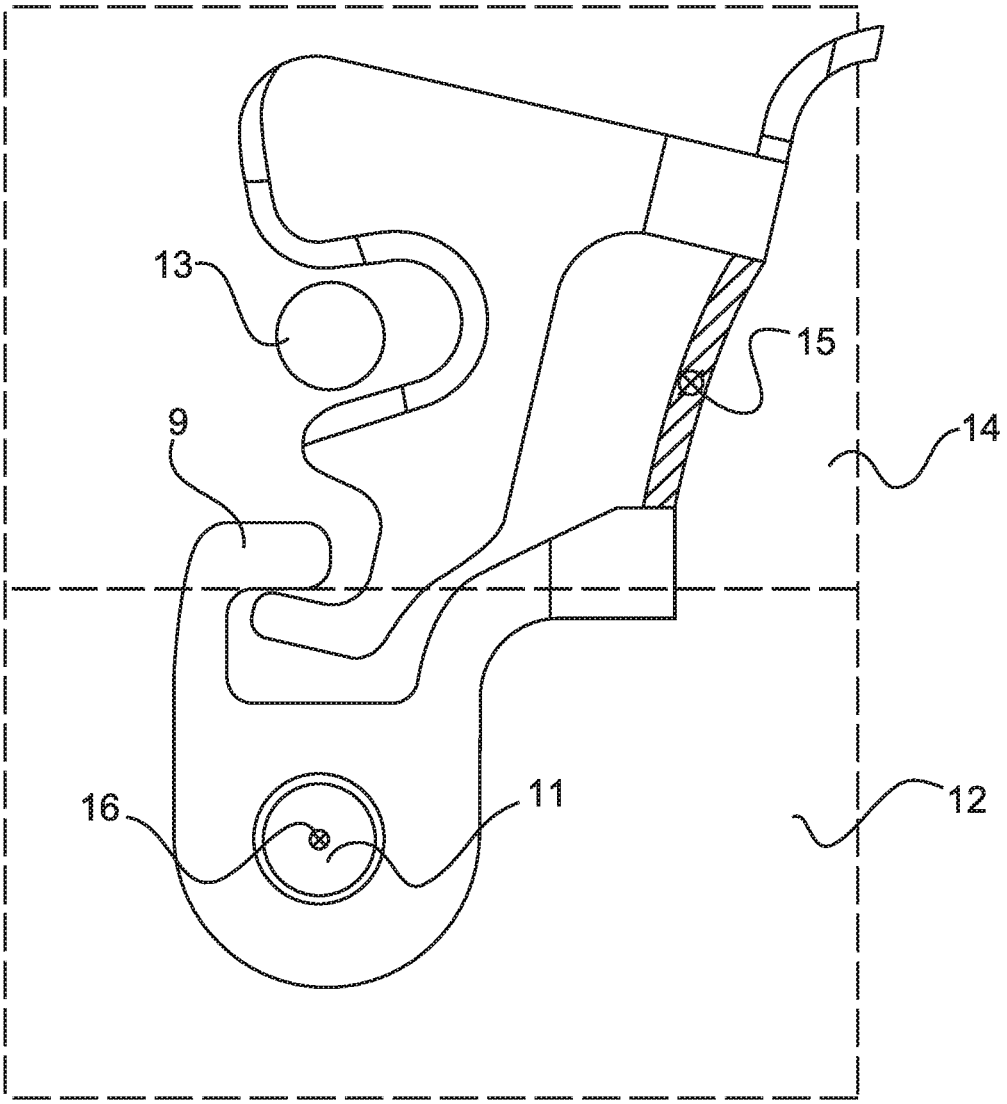
FIG. 4*b* illustrates a further schematic view of an opening pivot movement of the locking clip.
Figure 4C:
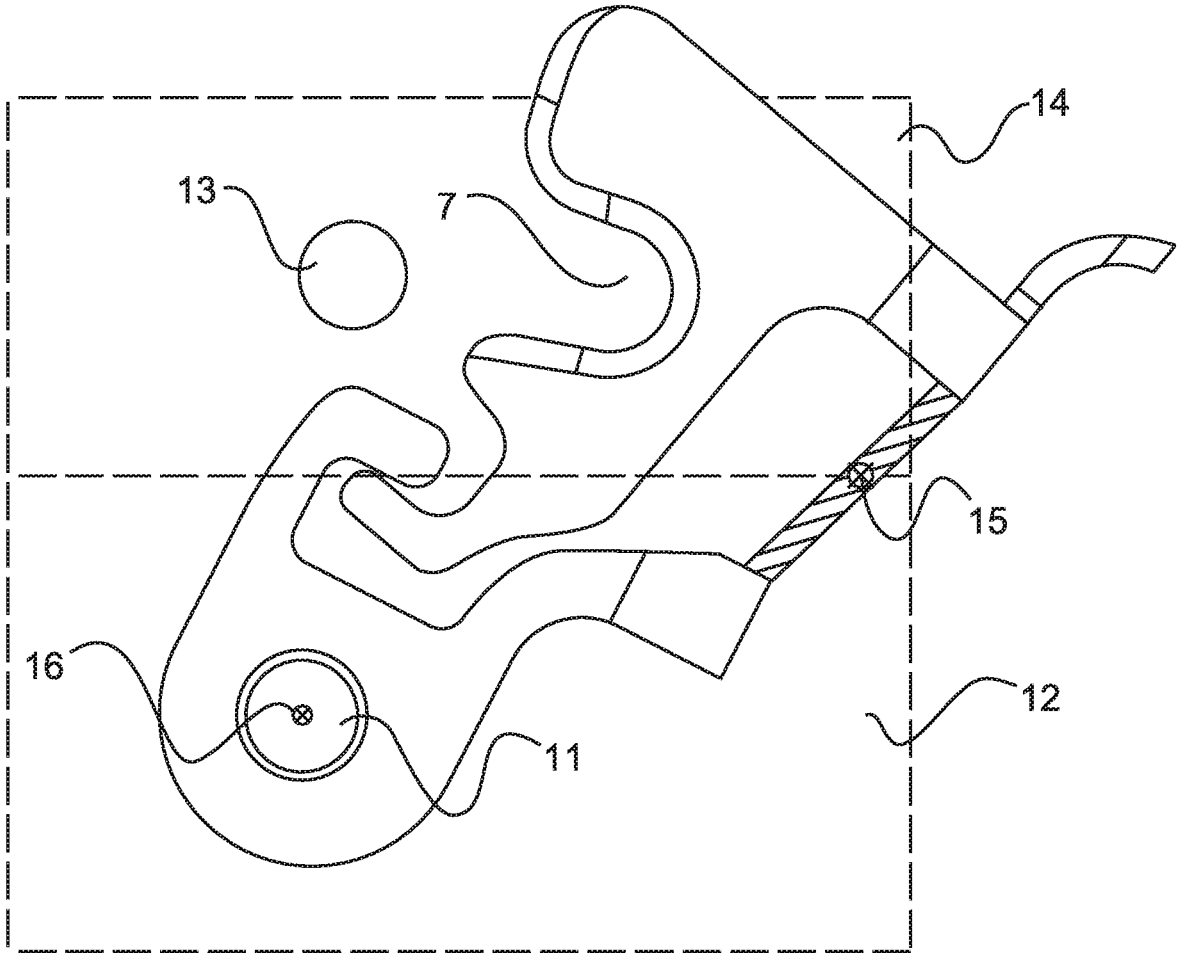
FIG. 4*c* illustrates a further schematic view of an opening pivot movement of the locking clip.

An opening pivot movement of a possible embodiment of the locking clip 1 is illustrated schematically in FIGS. 4*a-c*. For illustration reasons, the plug connector housings 12, 14 are only indicated by broken lines. The opening pivot movement with the locking clip 1 in accordance with the invention may be described via two or three different states:

The plug connector housings 12, 14 are locked together. In the first state, the above described levers 8, 9 are oriented parallel to one another in the pivot direction and overlap one another at least in part. The levers 8, 9 are spaced apart from one another. The distance d between the levers 8, 9 is greater than zero. The arm levers are located in the same plane with the result that it is possible to bring them into contact with one another. The above described pivot movement is performed along a first axis of rotation 15 that lies in the region of the rear wall 2 or rather on the rear wall 2. The rear wall 2 is bent during this pivot movement, as is apparent in FIG. 4*b*.

During the opening pivot movement of the locking clip 1 along a first travel path, the above mentioned arm levers 8, 9 are brought into contact with one another. The distance d between the arm levers is equal to zero in this case. The pivot movement now moves into a second state. During the further pivot movement of the locking clip 1, the arm levers 8, 9 remain in contact with one another as in the following description. The locking clip 1 is moved in so doing along a second axis of rotation 16. The second axis of rotation 16 is formed by the connecting line of the pivot pins 11 of the first plug connector housing 12. The further pivot movement must be performed with a greater application of force than the first pivot movement during which the arm levers 8, 9 are not yet in contact with one another. The receiving slots 7 are pivoted away over the locking pins of the second plug connector housing 14.

The third state of the opening pivot movement is apparent in FIG. 4*c*. In the third state, the locking pins 13 of the second plug connector housing 14 are not gripped by the receiving slots 7 of the locking clip 1.

During the closing pivot movement of the locking clip 1—in the opposite direction to the arrow 10—the arm levers 8, 9 are in contact with one another. If the locking clip 1 is pivoted over the locking pins 13, 13', the contact is removed and a defined distance d becomes apparent between the upper arm levers 8, 8' and the lower arm lever 9, 9'. The distance d defines the above mentioned distance between the upper and lower arm levers 8, 8', 9, 9' and is between 0.6 mm up to 2 mm, wherein the boundary values are specifically included. This distance has proven itself to be particularly advantageous both during the closing pivot movement and also during the opening pivot movement of the locking clip. The usability of the locking clip is thereby increased.

LIST OF REFERENCE NUMERALS

1 Locking clip
2 Rear wall
3 Lower arm
4 Upper arm
5 Actuating grip
6 Pivot hole
7 Receiving slot
8 Upper Arm lever
9 Lower arm lever
10 Arrow
11 Pivot pin
12 First plug connector housing
13 Locking pin
14 Second plug connector housing
15 First axis of rotation
16 Second axis of rotation
d Distance

The invention claimed is:

1. A locking clip for coupling a first connector housing to a second connector housing, comprising:

a rear wall;

lower arms arranged in parallel planes extending perpendicularly on opposite sides from a lower portion of the rear wall;

pivot holes formed coaxially in each of the lower arms;

upper arms arranged in the parallel planes extending perpendicularly on opposite sides from an upper portion of the rear wall, the upper arms being pivotable relative to the lower arms by bending the rear wall;

receiving slots, one receiving slot formed in each of the upper arms, each receiving slot extending inwardly towards the rear wall and upwardly away from the lower arm;

lower arm levers, one lower arm lever formed in each of the lower arms extending towards the rear wall; and upper arm levers, one upper arm lever formed in each of the upper arms extending away from the rear wall, the upper arm levers being arranged below and at a distance from the lower arm levers, wherein, in a locked position, the pivot holes are held by pivot pins of the first connector housing and the receiving slots engage locking pins of the second connector housing.

2. The locking clip as in claim 1, wherein the locking clip is disengaged from the second connector housing in a two-step motion, including bending the rear wall and pivoting the upper arms relative to the lower arms until the upper arm levers push against the lower arm levers and jointly pivoting the rear wall, the upper arms and the lower arms about the pivot holes while the upper arm levers push against the lower arm levers.

3. The locking clip as in claim 2, wherein bending the rear wall and pivoting the upper arms relative to the lower arms requires applying a first force over a first travel path and wherein jointly pivoting the rear wall, the upper arms and the lower arms about the pivot holes while the upper arm levers push against the lower arm levers requires applying a second force over a second travel path, the first force being smaller than the second force.

4. The locking clip as in claim 1, wherein free ends of the lower arm levers are arranged above and overlap with free ends of the upper arm levers, and wherein the lower arm levers and the upper arm levers are oriented parallel to one another.

5. The locking clip as in claim 1, wherein a distance (d) between the lower arm levers and the upper arm levers is greater than zero when the locking clip is in a locked state and wherein the distance (d) between the lower arm levers and the upper arm levers can be reduced to zero by bending the rear wall to disengage the locking clip.

6. The locking clip as in claim 5, wherein reducing the distance (d) between the lower arm levers and the upper arm levers to zero requires applying a first force to the upper portion of the rear wall over a first travel path and wherein disengaging the locking clip requires subsequent application of a greater second force to the upper portion of the rear wall over a second travel path while the upper arm levers and the lower arm levers are in contact with one another during the second travel path.

7. The locking clip as in claim 1, wherein the rear wall, the upper arms and the lower arms are integrally formed as a single piece.

8. The locking clip as in claim 7, wherein the locking clip is made of resilient sheet metal.

9. The locking clip as in claim 1, wherein an actuating grip is formed on the rear wall.

10. The locking clip as in claim 9, wherein the actuating grip is formed as an outwardly bent portion of the rear wall upwardly of the upper arms.

* * * * *